US005747126A

United States Patent [19]

Van Erden et al.

[11] Patent Number: 5,747,126

[45] Date of Patent: May 5, 1998

[54] ULTRAVIOLET EXCITED FUSIBLE RIBS FOR PLASTIC ZIPPER PROFILES

[75] Inventors: Donald Van Erden, Wildwood; Art Malin, Northbrook, both of Ill.

[73] Assignee: Illinois Tool Works Inc., Glenview, Ill.

[21] Appl. No.: 590,104

[22] Filed: Nov. 6, 1995

[51] Int. Cl.[6] ..... B32B 3/06; B65D 33/16

[52] U.S. Cl. ..... 428/35.2; 428/35.5; 428/100; 428/133; 428/138; 24/586; 24/587; 24/589; 383/61; 383/63

[58] Field of Search ..... 383/61, 63, 93; 24/576, 586–588, 399, 400, 304; 428/35.2, 35.5, 99, 100, 131, 133, 138

[56] References Cited

U.S. PATENT DOCUMENTS

| | | | |
|---|---|---|---|
| 4,673,383 | 6/1987 | Beutsen | 493/381 |
| 5,216,787 | 6/1993 | Custer et al. | 24/587 |
| 5,242,516 | 9/1993 | Custer et al. | 383/63 |
| 5,403,094 | 4/1995 | Tomic | 383/63 |
| 5,486,051 | 1/1996 | May | 383/63 |
| 5,489,252 | 2/1996 | May | 383/63 |
| 5,566,429 | 10/1996 | Martinez et al. | 24/587 |

*Primary Examiner*—Rena Dye
*Attorney, Agent, or Firm*—Kane,Dalsimer,Sullivan, Kurucz, Levy, Eisele and Richard, LLP

[57] ABSTRACT

A reclosable bag is formed of a first wall and a second wall of a polymeric sheet material joined to form an enclosure with a mouth defined by the wall edges. The bag has a closure for selectively opening and sealing the mouth. The closure includes a first and a second mutually interlocking profile, each of which extends along and is bonded to the internal surface of its respective first and second wall. The first and second mutually interlocking profiles are extruded from a first polymeric resin material, and have a web portion which is bonded to the wall. Coextruded onto the web portions, or applied to the web portions following the extrusion of the strips, is at least one rib of a second polymeric resin material which includes an ultraviolet-light-excitable tracer material. The second polymeric resin material has a lower melting point than the first polymeric resin material, and is used to bond the profiles to the sheet material of the walls. Before such bonding, the ribs appear as discrete lines under ultraviolet light. After a complete bonding, the ribs disappear and are replaced by a smeared brightening of the region between the profiles and the sheet material of the walls. The appearance of ribs after bonding indicates an unsuccessful bonding operation that could possibly lead to an increase in the occurrence of leaking packages.

12 Claims, 4 Drawing Sheets

ULTRAVIOLET EXCITED FUSIBLE RIBS FOR PLASTIC ZIPPER PROFILES

BACKGROUND OF THE INVENTION

1. Field of the Invention

The present invention relates to the manufacture of plastic bags or packages having at least two plies of thermoplastic sheeting, both plies having closure strips included on their facing inner surfaces so as to form a zipper-like closure for the openings of the bags or packages made therefrom. The plies may be formed from two separate sheets or from a single sheet folded over. More specifically, in accordance with the present invention, the closure strips are provided with fusible ribs, by which they may be bonded to the thermoplastic sheet material. The fusible ribs may be coextruded with the closure strips from a material having a melting point lower than those of the sheet material and strips, or may be applied to the closure strips following the extrusion of the strips. The fusible ribs include an optical brightener which while not visible under fluorescent light or sunlight, is readily apparent when viewed under an ultraviolet light source. Before bonding, the fusible ribs appear as a number of discrete parallel lines under ultraviolet light. After a complete bonding the discreteness is lost and the entire contact area between the sheet material and closure strips appears brightened, indicating that the fusible ribs completely melted and filled the space between the closure strips and the thermoplastic sheet material. In short, the smearing is used as an indication that the closure strips have been completely bonded to the sheet material.

2. Description of the Prior Art

The present invention relates to improvements in the package-making art and may be practiced, without limitation, in the manufacture of thermoplastic bags and trays of the kind that may be used for various consumer products, but which are particularly useful for food products which must be kept in moisture- and air-tight packages, free from leakage until opened for access to the product contents, which packages are then reclosable by zipper means to protect any remainder of the product therein.

The indicated art is fairly well-developed, but nevertheless is still susceptible to improvements contributing to increased efficiency and cost effectiveness.

The zipper means alluded to in the above are most commonly male and female interlocking zipper profiles extruded from low-density polyethylene (LDPE). These zipper profiles are usually attached to the polymeric sheet material, from which bags or packages are being produced, either during a separate bag formation operation or in conjunction with the bag filling operation on a form-fill-and-seal (FFS) machine. The former provides empty bags to be separately filled, while the latter provides filled bags.

While FFS machines are of several specific designs, all comprise a filling tube, about which the bags or packages are formed and through which premeasured amounts of a consumer product, such as a food material, may drop as individual bags or packages are being produced in a sequential fashion. On the FFS machine, polymeric sheet material is directed toward and around the filling tube by means of a forming collar, the two lateral edges thereof being brought together to form a fin extending outward from and longitudinally along the filling tube. The male and female interlocking zipper profiles may be directed between the two lateral edges and are joined or heat-sealed thereto to form the facing inner surfaces of the reclosable bag opening.

The present invention is directly related to the attachment of the male and female interlocking zipper profiles to the polymeric sheet material. Most often, the attachment is effected by heat-sealing. It is important that the heat-sealing be done in such a manner that the mutually interlocking members on the male and female interlocking profiles do not get damaged or deformed by the heat used to bond them to the sheet material. This consideration has long governed approaches for the attachment of zipper profiles to polymeric sheet material.

For example, U.S. Pat. No. 4,673,383 to Bentsen shows a plastic separable fastener strip having fusible ribs on the base surface of the fastener strip to provide a bonding layer for bonding the strip to a substrate. Reducing the ribs into fusible condition without heat distortion of the remainder of the fastener strip and without heat distortion or damage of the substrate provides a bonding layer when the fused ribs of the fastener strip are pressed together with the substrate. The plastic separable fastener strip may be an extrusion formed from a suitable thermoplastic material, such as polyethylene, polypropylene or an ethylene acid copolymer (available as SURLYN®, a Dupont trademark) depending upon the circumstances of its use. The fusible ribs are integrally extruded as part of the plastic separable fastener-strip, and, therefore, have the same melting point. In practice, it has been found that the interlocking portions of the fastener strips are too frequently damaged or distorted during the attachment process by the heat required to melt the ribs.

U.S. Pat. No. 5,216,787 to Custer et al. shows a profile strip having a closure element made of a first material. The closure element contains a base surface and lateral webs or flanges extending from the base surface on each side thereof. An adhesive layer, made of a second material, different from the first material, is attached to the lateral webs, but not to the base surface by co-extrusion therewith. The adhesive layer is subdivided into adhesive ribs, with each pair of adjacent ribs separated from each other by an adhesive-free area. Subdividing the adhesive layer into ribs separated by an adhesive-free area is said to substantially eliminate the deformation of the lateral webs when they—and the adhesive ribs—are cooled after extrusion. The adhesive ribs are generally formed of a second material having a lower melting point than the first material of the profile strip to ensure that the profile strip, and especially its closure element, are not damaged or distorted by the heat required to attach it to thermoplastic sheet material.

In practice, the attachment of profile strips to the thermoplastic sheet material is often incomplete, causing the bond between them to fail in use. In addition, the occurrence of packages which leak through the regions where the profile strips intersect the side seals continue to be a problem. Underlying these problems is the difficulty in identifying whether the profile strips are being successfully joined to the thermoplastic sheet material. The present invention provides a means for ensuring that the attachment is complete.

SUMMARY OF THE INVENTION

Accordingly, the present invention is a reclosable bag or package, and a closure therefor. The reclosable bag comprises a first wall and a second wall of polymeric sheet material joined to form an enclosure with a mouth defined by wall edges.

The reclosable bag also comprises a closure for selectively opening and sealing the mouth of the bag. The closure comprises a first and a second mutually interlocking profile. The first profile extends along and is bonded to an internal surface of the first wall, and may be a male interlocking profile. The second profile extends along and is bonded to an internal surface of the second wall, and may be a female interlocking profile.

Both the first and second mutually interlocking profiles are extruded from a first polymeric resin material, which may be low-density polyethylene (LDPE). Both profiles include a web portion and an interlocking member (male or female) on one side of the web portion.

Prior to bonding to the first and second walls, at least one rib of a second polymeric resin material is on the other sides of the web portions from the interlocking members. The rib or ribs may be coextruded with the web portions from the second polymeric material, which has a melting point lower than that of the first polymeric material, or the rib or ribs may be applied onto the web portions following the extrusion of the profiles. The second polymeric material may comprise an ethylene-methacrylic acid copolymer, such as NUCREL®, which is available from Dupont. Such a material permits first and second mutually interlocking profiles of low-density polyethylene (LDPE) to be bonded to first and second walls of SURLYN® sheet material. SURLYN® is an ionomer resin comprising an ethylene-methacrylic acid copolymer having acid sites cross-linked by metallic cations, and is also available from Dupont. NUCREL® is a precursor of SURLYN®.

In any event, the second polymeric resin material also includes an ultraviolet-light-excitable tracer material so that the rib or ribs may be made visible under ultraviolet light. Typically, such a tracer material will glow or fluoresce in a characteristic visible color under ultraviolet light. The tracer material may be an optical brightener, such as PM1352E7 from Techner PM, Inc. of Rancho Dominguez, Calif. The active ingredient in this optical brightener is benzoxazole.

After the bonding of the first and second mutually interlocking profiles to the first and second walls, respectively, which is effected by melting the second polymeric resin material of the rib or ribs to join the profile to the wall, the rib or ribs are no longer visible as discrete lines under ultraviolet light. Rather, the entire boundary between the web portion and wall will optimally emit the characteristic visible light color upon exposure to ultraviolet light. Such a finding will indicate that the rib material has completely melted, filled the space between the web portion and wall, and solidified to bond the profile to the wall. On the other hand, should a rib or ribs still be visible following the bonding, it would indicate that the rib material has not melted to bond the profile to the wall. Thus, the addition of the ultraviolet-light-excitable tracer material to the material from which the ribs are extruded provides a valuable quality control for the bag or package manufacturer, allowing him to ensure the complete bonding of the profiles to the walls and to minimize and eliminate the occurrence of leaking packages ("leakers").

This and other advantages of the present invention will become apparent to the reader with the more complete description to follow. Reference will be made therein to the drawing figures identified below.

DETAILED DESCRIPTION OF THE PREFERRED EMBODIMENT

Figure 1:
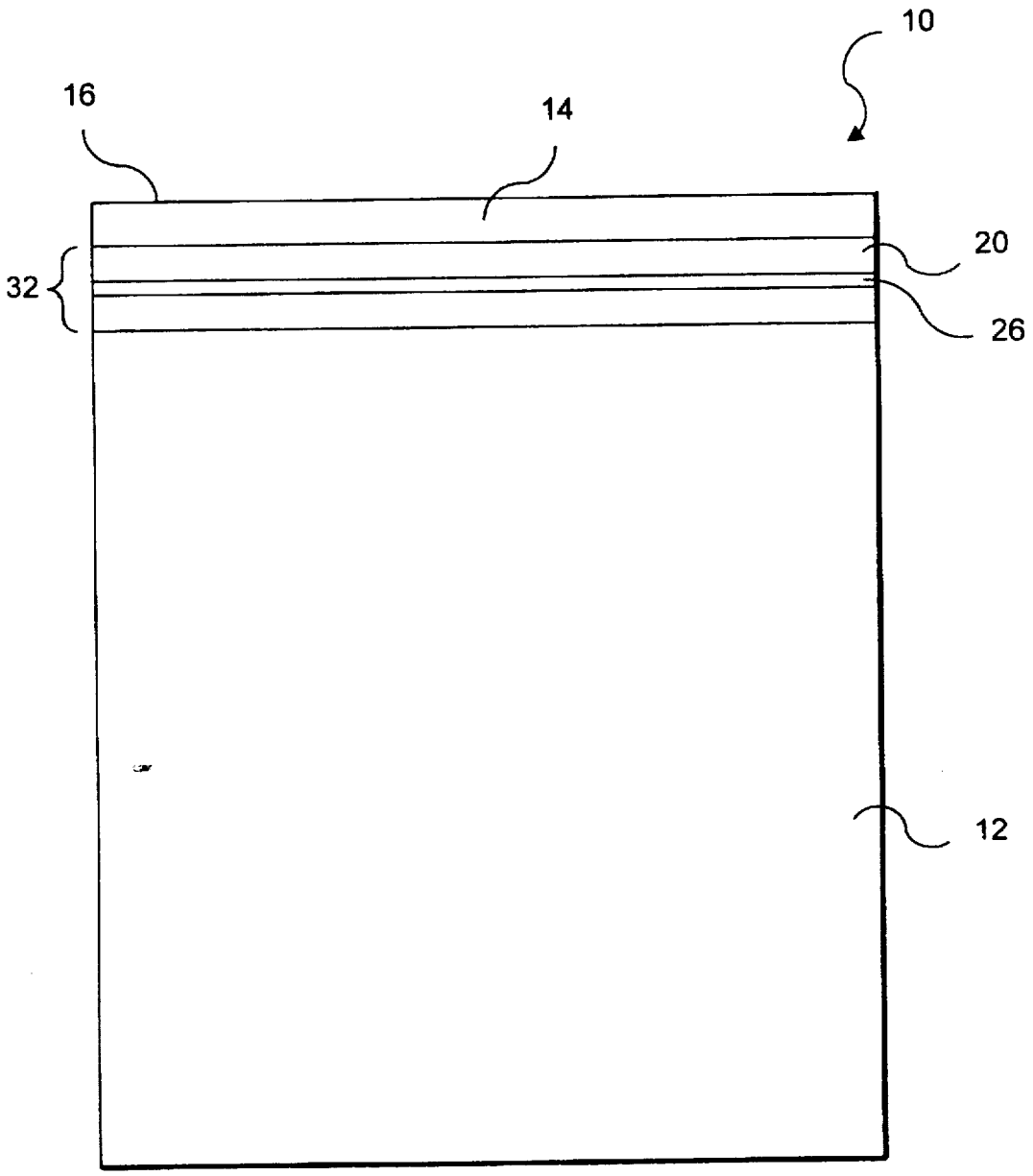
FIG. 1 shows a plan view of a reclosable bag constructed in accordance with the present invention.

Referring now to the drawings, a reclosable bag 10 constructed in accordance with the present invention includes a first (front) wall 12 and a second (rear) wall, not visible in FIG. 1, seamed along two, or possibly three, edges thereby forming an enclosure with an opening or mouth 14 along the top or fourth edge 16. The bag 10 is preferably made from a polymeric sheet material. One such material may be polyethylene. Another may be the above-mentioned SURLYN®, an ionomer resin. The sheet material may be formed by extrusion.

Figure 2:
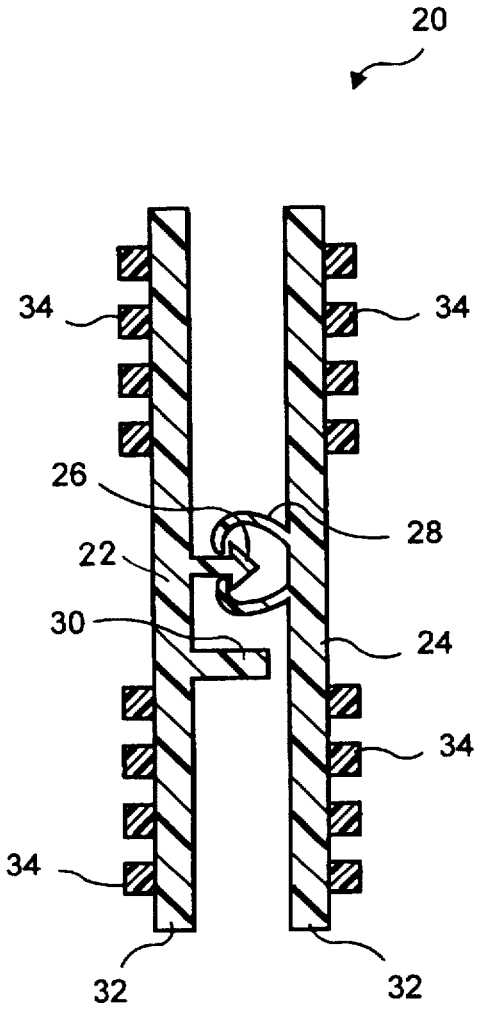
FIG. 2 shows a cross-sectional view taken through the closure of the present invention.

FIG. 2 is a cross-sectional view taken through the closure 20 of the present invention. The closure 20 comprises a first mutually interlocking profile 22, to which the first (front) wall 12 is ultimately bonded, and a second mutually interlocking profile 24, to which the second (rear) wall is ultimately attached.

The first mutually interlocking profile 20 may be a male interlocking profile, as suggested by male interlocking member 26. The second mutually interlocking profile 22 may be a female interlocking profile, as suggested by female interlocking member 28. The first mutually interlocking profile 22 may also be provided with guide rail 30 to facilitate the proper positioning of the male interlocking profile 26 relative to the female interlocking profile 28 prior to interlocking. While a specific variety of male and female interlocking profiles has been illustrated in FIG. 2, it should be understood that this is intended to be an example only, and that the present invention may be practiced with mutually interlocking profiles of all types.

First and second mutually interlocking profiles 22, 24 may be extruded from a first polymeric resin material, such as low-density polyethylene (LDPE).

First and second mutually interlocking profiles 22, 24 each include a web portion 32, which is ultimately attached to the walls of polymeric sheet material forming a reclosable bag. On the opposite sides of the web portions 32 from the male and female interlocking members 26, 28 are at least one, and preferably a plurality, of ribs 34 of a second polymeric resin material, which functions as an adhesive to bond the web portions 32 to the polymeric sheet material. The second polymeric resin material has a lower melting point than the first polymeric resin material, so that it may be fused to join the profiles 22, 24 to polymeric sheet material without damaging or distorting elements, such as the male and female interlocking members 26, 28, thereof. The second polymeric material may be NUCREL®, the above-mentioned ethylene-methacrylic acid copolymer. Preferably the ribs 34 are coextruded from the second polymeric resin material onto the web portions 32, but they also may be applied to the web portions 32 following the extrusion of the profiles 22, 24.

The second polymeric material includes an ultraviolet-light-excitable tracer material, so that the ribs 34 may be visible, and stand out sharply, when exposed to a ultraviolet light source, such as a "black" light. As mentioned above, the ultraviolet-light-excitable tracer material may be an optical brightener having benzoxazole as its active ingredient.

The ultraviolet-light-excitable tracer material is provided as a quality control feature to enable a bag or package maker to verify that the first and second interlocking profiles 22, 24 have been completely bonded to the polymeric sheet material being used. That is to say, if following the manufacture of a bag, ribs were still visible under ultraviolet light on web portion 32 in FIG. 1, it would indicate that the web portion 32 has not been acceptably bonded to the polymeric sheet material of the first wall 12. On the other hand, where discrete ribs 34 are no longer visible and instead the entire region between the web portion 32 and polymeric sheet material of the first wall 12 glows under ultraviolet light, it would indicate that the ribs 34 completely melted and that the second polymeric material of the ribs 34 flowed to completely fill the space between the web portions 32 and the polymeric sheet material of the first wall 12 and second wall to bond the first and second mutually interlocking profiles 22, 24 thereto. Further, should the ribs 34 completely melt, but in resolidifying leave an air gap or pocket between the web portion 32 and the polymeric sheet material, the air gap or pocket would change the light reflective and refractive properties of the region of the web portion 32 and would thereby be made apparent.

Figure 3:
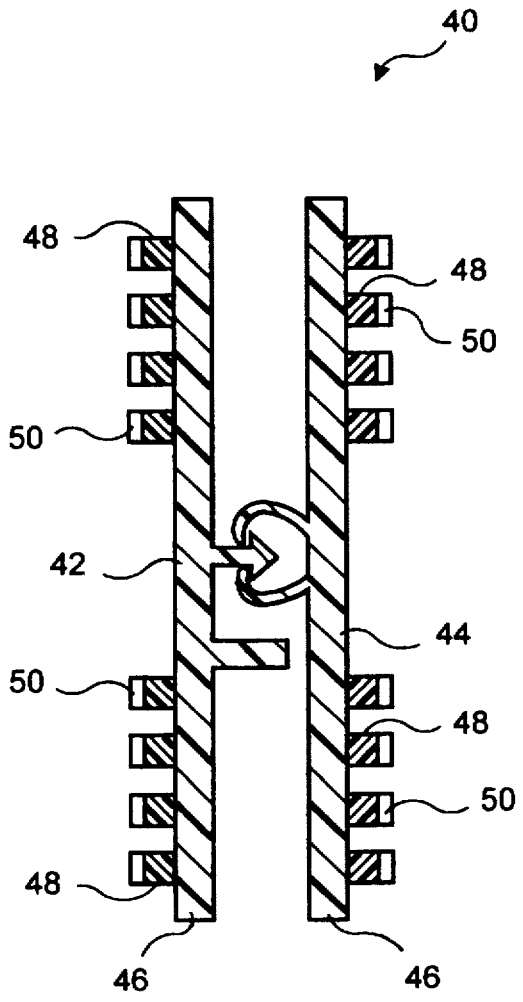
FIG. 3 shows a cross-sectional view taken through an alternate embodiment of the closure.

FIG. 3 shows a cross-sectional view taken through an alternate embodiment of the closure of the present invention. Closure 40 comprises a first mutually interlocking profile 42 and a second mutually interlocking profile 44. Again, first and second mutually interlocking profiles 42, 44 may be extruded from a first polymeric resin material, such as low-density polyethylene (LDPE).

First and second mutually interlocking profiles 42, 44 each include a web portion 46, which is ultimately attached to the walls of polymeric sheet material forming a reclosable bag. Web portions 46 include at least one, and preferably a plurality, of ribs 48 of a second polymeric resin material, which functions as an adhesive to bond the web portions 46 to the polymeric sheet material. As above, the second polymeric resin material has a lower melting point than the first polymeric resin material, and may be NUCREL®. Preferably, the ribs 48 are coextruded from the second polymeric resin material onto the web portions 46, but they also may be applied to the web portions 46 following the extrusion of the profiles 42, 44.

On at least a portion of the ribs 48 is an ultraviolet-light-excitable tracer material 50, which may be applied to the ribs 48 after their attachment, by coextrusion or otherwise, to the web portions 46.

Figure 4:
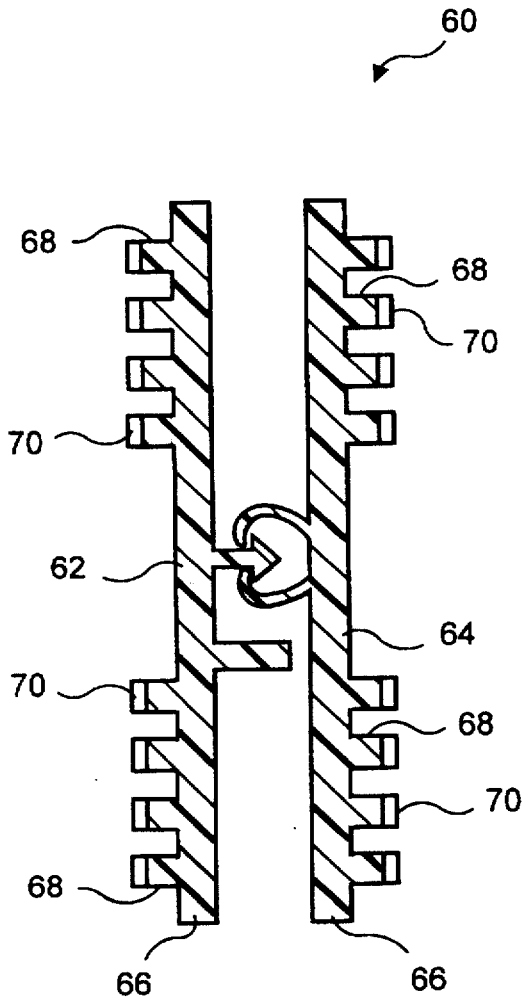
FIG. 4 shows a cross-sectional view taken through still another embodiment of the closure.

FIG. 4 shows a cross-sectional view taken through still another embodiment of the closure of the present invention. Closure 60 again comprises a first mutually interlocking profile 62 and a second mutually interlocking profile 64. Again, first and second mutually interlocking profiles 62, 64 may be extruded from a first polymeric resin material, such as low-density polyethylene (LDPE).

First and second mutually interlocking profiles 62, 64 each include a web portion 66. At least one, and preferably a plurality, of ribs 68 are coextruded from the first polymeric resin material and are ultimately used to bond web portions 66 to the polymeric sheet material.

On at least a portion of the ribs 68 is an ultraviolet-light-excitable tracer material 70, which may be applied to the ribs 68 after the extrusion of the first and second mutually interlocking profiles 62, 64.

Several variations of the present invention have been contemplated by its inventors based on the availability of a number of ultraviolet-light-excitable tracer materials, each of which glows in its own characteristic color under ultraviolet light.

For example, a tracer material which emits one color, perhaps yellow, may be included in the second polymeric material forming the ribs 34 on the first mutually interlocking profile 22, while a tracer material which emits another color, perhaps blue, may be included in the second polymeric material forming the ribs 34 on the second mutually interlocking profile 24. After cross seals are made and the manufacture of a package finished, the edge of the side seal may be viewed under ultraviolet light. If a third color, such as green, where separate tracer materials emitting yellow and blue under ultraviolet light are used, is observed, complete fusion of both sets of ribs 34 and a complete mixing of the molten rib material, would be indicated. This, in turn, would indicate a complete seal at the side seal of the package.

Further, as a refinement of this example, one could make the first mutually interlocking profile 22 of a transparent yellow material, and include a tracer material emitting blue light under ultraviolet light, and the second mutually interlocking profile 24 of a transparent blue material, and include a tracer material emitting yellow light under ultraviolet light. This would enable one to see the ribs 34 spread during welding, when observed under ultraviolet light, and would also provide the advantage described in the preceding paragraph.

This refinement has a further advantage where holes have been punched from the first and second mutually interlocking profiles 22, 24 through the interlocked male and female interlocking members 26, 28 to remove material from the location of the side seal prior to its formation, while leaving the web portions 32 and at least some ribs 34 on each intact. During the welding operation, the ribs 34 will melt and flow into the punched hole, where the side seal will later be made, to caulk the ends of the closure. A complete mixing of the tracer materials of the ribs 34 from both web portions 32 will be indicated under ultraviolet light by the appearance of a third color, green in the present scenario.

Many other advantages will become apparent to those of ordinary skill in the art. Obviously, numerous modifications may be made to this invention without departing from its scope as defined in the appended claims.

What is claimed is:

1. A closure for selectively opening and sealing the mouth of a reclosable bag, said closure comprising:

a first mutually interlocking profile and second mutually interlocking profile extruded from a polymeric resin material, said first and second mutually interlocking profiles including a web portion, an interlocking member on one side of said web portion, and at least one fusible rib of a polymeric resin material on the other side of said web portion, said at least one fusible rib on at least a portion thereof including an ultraviolet-light-excitable tracer material, so that said ribs may be visible under ultraviolet light and whereby upon bonding said closure to a bag material the region of said bond may be viewed under ultraviolet-light to determine that said ribs have fused to said bag material.

2. A closure as claimed in claim 1 wherein said ultraviolet-light-excitable tracer material is an optical brightener.

3. A closure as claimed in claim 2 wherein said optical brightener is benzoxazole.

4. A closure as claimed in claim 1 wherein said at least one fusible rib is coextruded onto the other side of said web portion.

5. A closure as claimed in claim 1 wherein said at least one fusible rib is applied onto the other side of said web portion following the extrusion of said first and second mutually interlocking profiles.

6. A closure as claimed in claim 1 wherein said first and second mutually interlocking profiles are extruded from a first polymeric resin material, and said at least one fusible rib is of a second polymeric resin material having a lower melting point than said first polymeric resin material.

7. A closure as claimed in claim 6 wherein said first polymeric material is low-density polyethylene (LDPE).

8. A closure as claimed in claim 1 wherein said first mutually interlocking profile is a male interlocking profile.

9. A closure as claimed in claim 1 wherein said second mutually interlocking profile is a female interlocking profile.

10. A closure as claimed in claim 6 said second polymeric material is an ethylene-methacrylic acid copolymer.

11. A closure as claimed in claim 6 wherein said ultraviolet-light-excitable tracer material is mixed through said second polymeric resin material of said at least one fusible rib.

12. A closure as claimed in claim 1 further comprising a second fusible rib spaced apart from and substantially parallel to said first fusible rib, said second fusible rib on at least a portion thereof including an ultraviolet-light-excitable tracer material, so that said ribs may be visible under ultraviolet light and whereby upon bonding said closure to a bag material the region between said fusible ribs may be viewed under ultraviolet-light to determine if said ribs are still discretely visible or if said ribs have fused to said bag material.

* * * * *